US010641002B2

(12) United States Patent
Szmyr

(10) Patent No.: US 10,641,002 B2
(45) Date of Patent: May 5, 2020

(54) PATIO SUPPORT BRACKET

(71) Applicant: Kaz Szmyr, Haydon (CA)

(72) Inventor: Kaz Szmyr, Haydon (CA)

( * ) Notice: Subject to any disclaimer, the term of this patent is extended or adjusted under 35 U.S.C. 154(b) by 0 days.

(21) Appl. No.: 15/428,971

(22) Filed: Feb. 9, 2017

(65) Prior Publication Data

US 2018/0224061 A1 Aug. 9, 2018

(51) Int. Cl.
*F16M 13/00* (2006.01)
*E04H 12/22* (2006.01)
*A45B 23/00* (2006.01)

(52) U.S. Cl.
CPC .. *E04H 12/2269* (2013.01); *A45B 2023/0012* (2013.01)

(58) Field of Classification Search
CPC ..... A47G 2033/1233; A47G 25/12; E04H 12/2253
USPC ..... 248/519, 523, 500, 507, 508
See application file for complete search history.

(56) References Cited

U.S. PATENT DOCUMENTS 4,235,409 A * 11/1980 Cummings ..... A01K 97/10 248/520
5,120,016 A 6/1992 Dysarz
5,632,112 A 5/1997 Steinborn
5,813,163 A * 9/1998 Dysarz ..... A01K 97/10 211/70.8
5,813,613 A 9/1998 Dysarz
5,895,017 A * 4/1999 McMillan, Jr. ..... B63B 29/06 248/188.1
6,497,067 B1 * 12/2002 King ..... A01K 97/10 248/538
6,908,067 B2 * 6/2005 Clasen ..... E04H 12/2223 248/533
6,953,180 B1 * 10/2005 Ruvalcaba ..... E04H 12/2215 135/118
6,955,330 B1 10/2005 Weiser et al.
7,156,357 B1 1/2007 Kocur
7,455,277 B2 * 11/2008 Bishop ..... E05B 73/00 248/156
7,575,215 B1 8/2009 Clark et al.
8,327,575 B1 12/2012 Zalewski
2011/0079700 A1 4/2011 Hilderbrand

* cited by examiner

*Primary Examiner* — Steven M Marsh
(74) *Attorney, Agent, or Firm* — Elias Borges

(57) ABSTRACT

Herein is disclosed a patio support for securely supporting an object to a patio deck. The patio support includes a base member for sitting on the patio deck, a mounting member for mounting the object to the base member, and an elongated member extending downwardly from the base member. The elongated member passes through the gap separating adjacent patio deck members and is sufficiently long that a hook formed on a lower end of the elongated member can be positioned below a lower edge of the joist supporting the deck members. The elongated member is movable between a lowered position wherein the hook is positioned below the lower edge of the joists and a raised position wherein the hook securely engages the lower edge of the joists. The patio support is further configured to lock the elongated member in its raised position.

13 Claims, 5 Drawing Sheets

PATIO SUPPORT BRACKET

BACKGROUND

The present invention relates to devices for securely mounting heavy object such as a patio umbrella onto a wooden patio deck.

Patio umbrella stands tend to be large and heavy. Due to the action of the wind on large opened patio umbrellas, large torsional forces are created where the umbrella stand is mounted to the umbrella shaft. As a result, unless the umbrella stand is very heavy and has a relatively large diameter, the umbrella stand is likely to topple over in even moderate winds. Of course the larger and heavier the umbrella stand is, the more difficult and awkward it is to use. An improved umbrella stand which is capable of supporting a large patio umbrella in without toppling in the wind is therefore desirable.

SUMMARY

The apparatus of the present invention consists of a support member configured to physically mount an object such as a patio umbrella to the decking of a patio by clamping between the decking members and the joists supporting the decking. The patio support consist of a flat base member dimensioned to lay on top of two adjacent deck members above a joist member, the base member dimensioned so as to span an elongated gap between the adjacent deck members and position a central portion of the base member directly above the elongated gap and supporting joist. The support further includes an elongated hook member extending downward from the central portion of the base member and down between the deck members, the hook member having a hook formed on a lower end thereof with the hook member being sufficiently long to engage a lower edge of the joist supporting the deck members. The base member is provided with an upwardly projecting support mount for mounting the object to the base member. The elongated hook member is elongated and has an upper end opposite the lower end. The hook member is movably mounted to the base member between a lowered position where the hook is positioned below the lower edge of the joist, and an upper position wherein the hook physically engages the lower edge of the joist, the hook member being lockable in its raised position. A portion of the elongated hook member adjacent the hook being substantially flat having a thickness dimensioned to fit within the elongated gap.

The invention is also directed at a patio support for securely supporting an object to a patio, the patio support being anchored to the parallel deck members and joist members forming the patio. The patio support includes a base member configured to rest on top of the deck members with a mounting member mounted to a top portion of the base member, the mounting member configured to releasably mount to the object. The patio support further includes an elongated member having opposite top and bottom ends, the bottom end extending downward from the base member, a hook portion formed on the bottom end, the elongated member being sufficiently long such that the bottom end can be extended below the lower edge of the joists. The elongated member is dimensioned to pass through the elongated gaps separating adjacent deck members. The elongated member is movably mounted to the base member and is movable between a lowered position wherein the hook is positioned below the lower edge of the joists and a raised position wherein the hook securely engages the lower edge of the joists. The patio support is configured to lock the elongated member in the elongated member's raised position.

DETAILED DESCRIPTION

Figure 1:
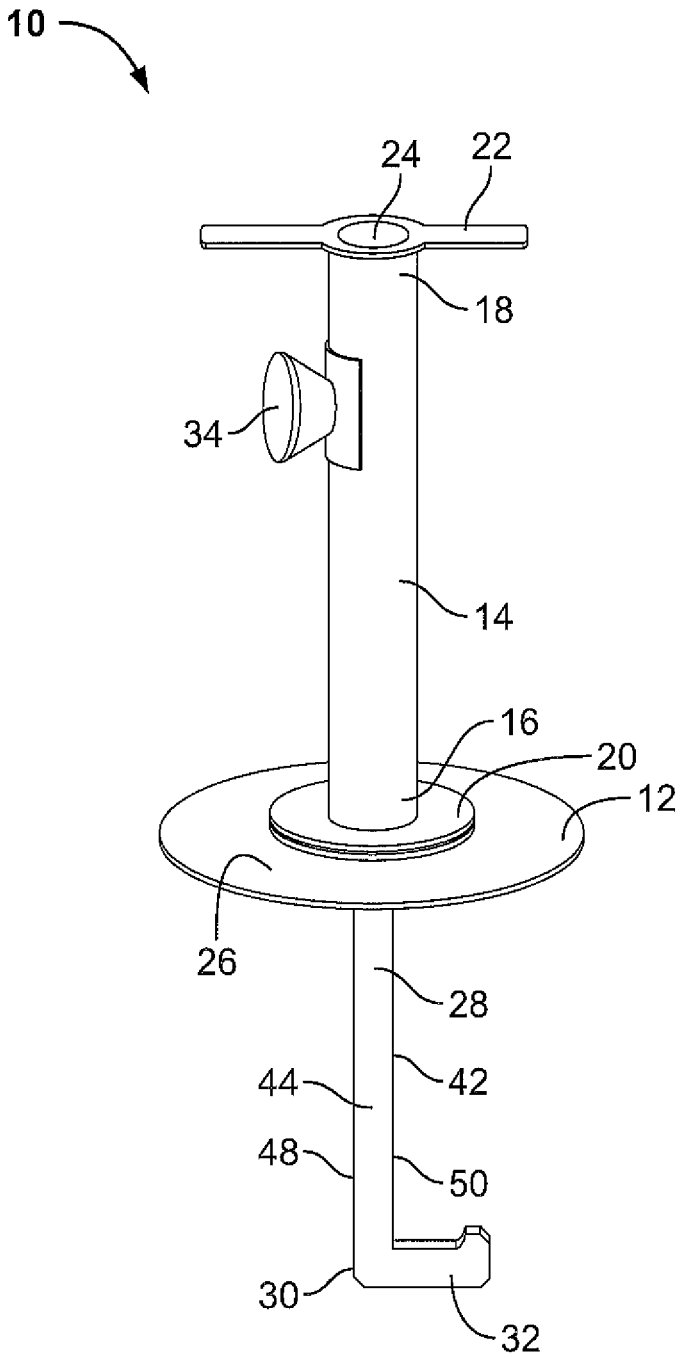
FIG. 1 is a perspective view of the patio mount device of the present invention.

Referring firstly to FIG. 1, a patio mount made in accordance with the present invention is shown generally as item 10 and consists of a flat base member 12 upon which a tubular cylinder 14 is coaxially mounted to. Tubular cylinder 14 has opposite ends 16 and 18, with flange 20 radiating outwards from end 16 and handles 22 projecting from end 18. Tubular cylinder 14 is hollow and has an opening 24 dimensioned to receive an object to be supported, such as the stem of a patio umbrella (not shown). A screw clamp 34 is provided on tubular cylinder 14 to secure the stem of the patio umbrella within the tubular cylinder.

Figure 2:
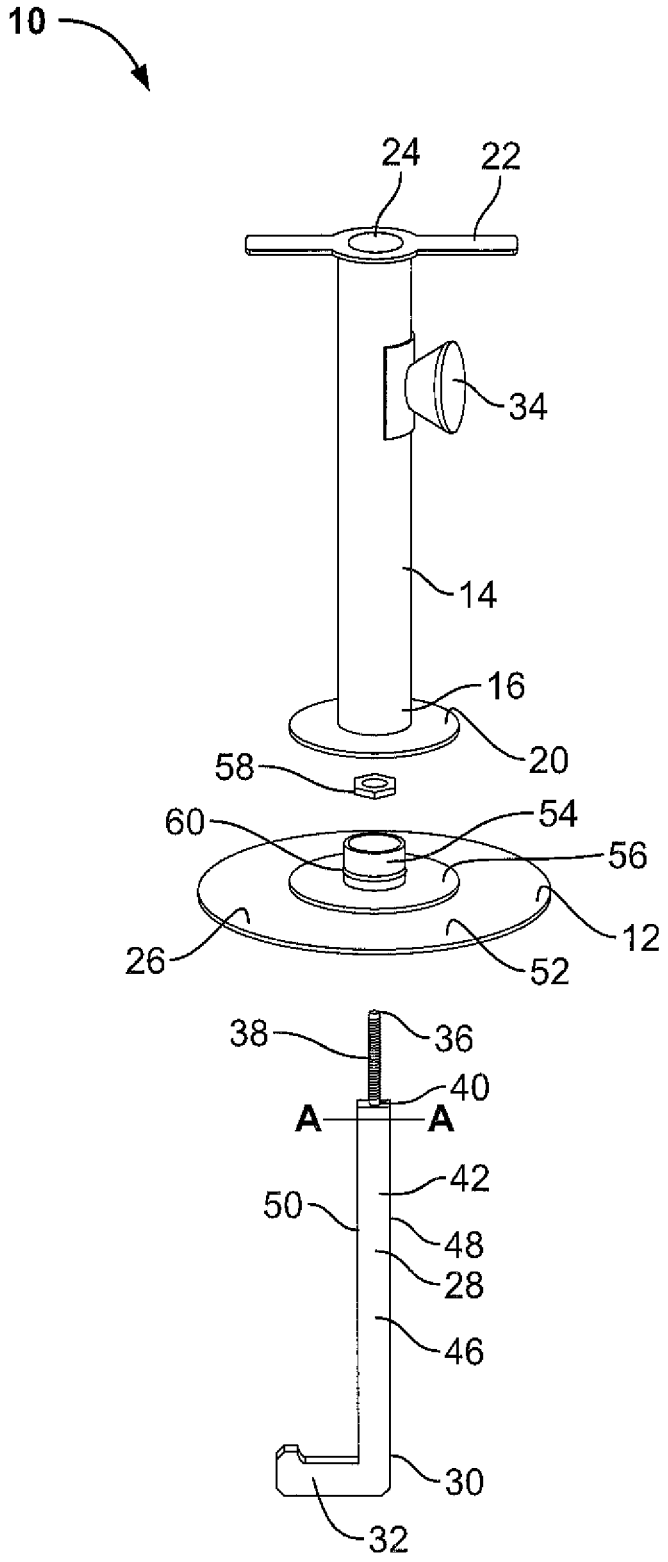
FIG. 2 is an exploded view of the patio mount shown in FIG. 1.

Depending downward from a central portion 26 of base member 12 is an elongated hook member 28 which has a lower end 30 with hook 32 formed thereon. As better seen in FIG. 2, elongated hook member has an upper end 36 opposite lower end 30. A cylindrical threaded section 38 extends between end 36 and point 40 where the cylindrical threaded section meets flat planar portion 42. Flat planar portion 42 continues towards end 30 to form hook 32, Flat planar portion 42 has opposite side faces 46 and 44 (FIG. 1) and opposite edges 48 and 50. The thickness of planar portion 42 is defined by the distance separating side faces 44 and 46 and the width of planar portion 42 is defined by the distance separating edges 48 and 50. Elongated hook member 28 is preferably made of a strong metal such as steel with threaded cylindrical threaded section secured to flat planar portion 42 by means known generally in the art such as welding.

Base member 12 is flat and planar and has a flat surface 52. Cylindrical collar 54 is formed at the center of base member 12 and washer 56 is concentrically placed around collar 54. Washer 56 preferably has substantially the same diameter as flange 20. Collar 54 has an outside diameter sufficient to fit snuggly within end 16 of cylinder 14 allowing the cylinder to be coaxially mounted to the collar and base member 12 while permitting the cylinder to rotate. Washer 56 is preferably made of a nonmetallic material such as plastic to prevent metal on metal contact between base member 12 and flange 20 to permit easy and smooth rotation of the cylinder on the base member. O-ring 60 is provided on collar 54 to help secure bottom end 16 of cylinder 14 onto the collar. Of course, O-ring 60 will be seated in an annular ring (not shown) which is formed on collar 54. Jam nut 58 is provided between cylinder 14 and base member 12 and is configured to thread onto cylindrical threaded portion 38 of elongated hook member 28. End 36 of elongated hook member is passed through an aperture in the center of base 12 and through the center of collar 54 before threading onto jam nut 58. As will be discussed later in the specification, jam nut 58 ensures that elongated hook member 28 does not accidentally fall away from base member 12.

Figure 4:
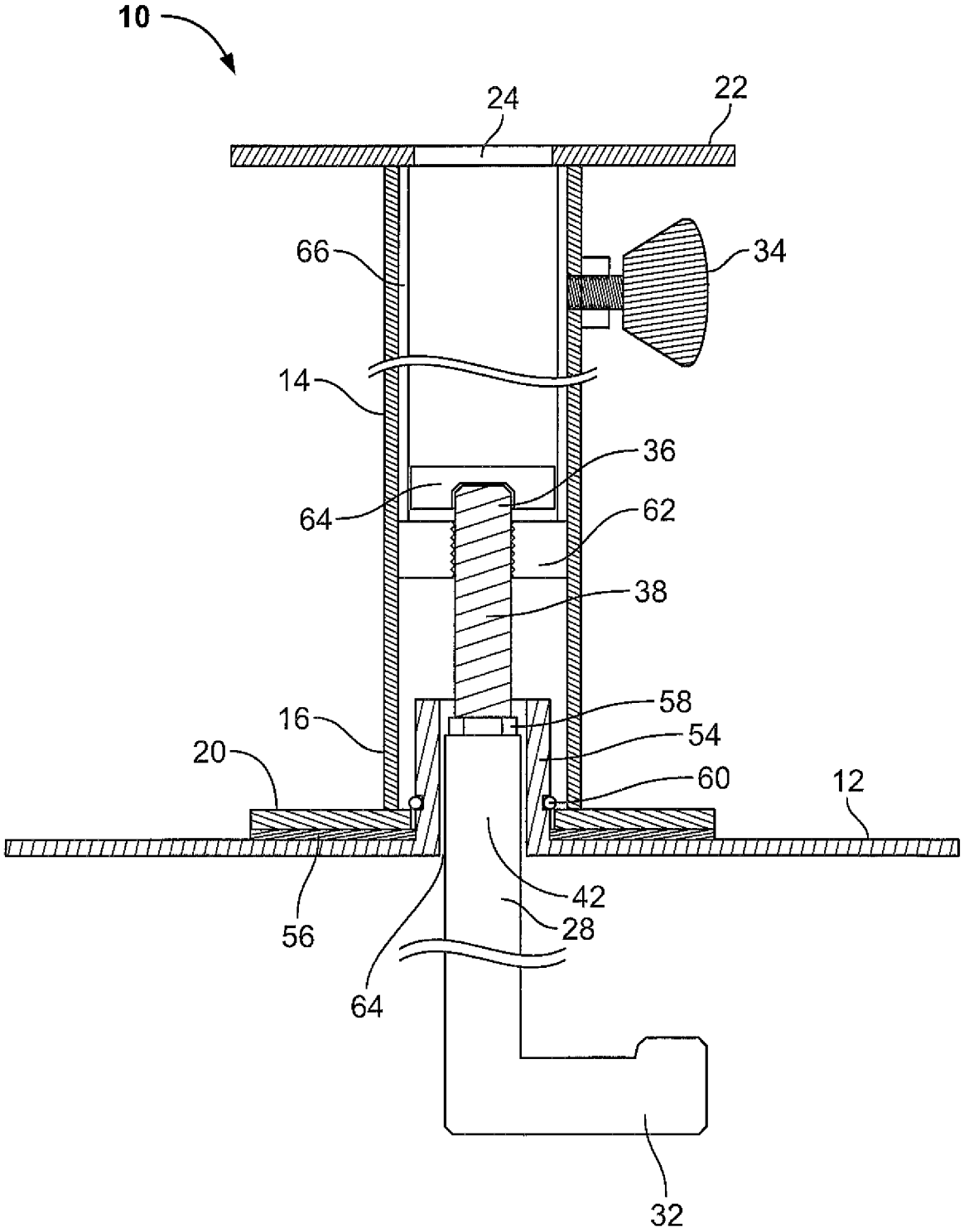
FIG. 4 is a long sectional view of the patio mount shown in FIG. 1.

Referring now to FIG. 4, cylinder 14 is provided with an internally threaded collar 62 which is rigidly secured within the cylinder and which is configured to thread onto threaded cylindrical section 38 of elongated hook member 28. Hook member 28 passes through a keyhole opening 64 at the centre of base member 12. Rotating cylinder 14 relative to base 12 causes threaded collar 62 to likewise rotate relative to threaded cylindrical section 38 which in turn causes elongated hook member to move in and out of cylinder 14. Jam nut 58 is threaded onto threaded cylindrical section 38 and positioned adjacent flat planar portion 42. Jam nut 58 is dimensioned such that it will not pass through keyhole aperture 64, thereby preventing elongated hook member 28 from falling away from base member 12 when the elongated hook member is not threaded into threaded collar 62. An internal lining 66 can be provided in cylinder 14 above threaded collar 62 and cap 64 can be provided to fit on top of end 36 of the elongated hook member. Liner 66 and cap 64 may be made of a polymer material such as plastic to prevent metal on metal contact between support 10 and the stem of a patio umbrella (not shown). When assembled, hook 32 on elongated hook member 28 can be raised or lowered simply by rotating cylinder 14 by engaging handle 22. Please note that FIG. 4 exaggerates the separation between collar 54 and cylinder 14 for the purposes of illustration.

Figure 5:
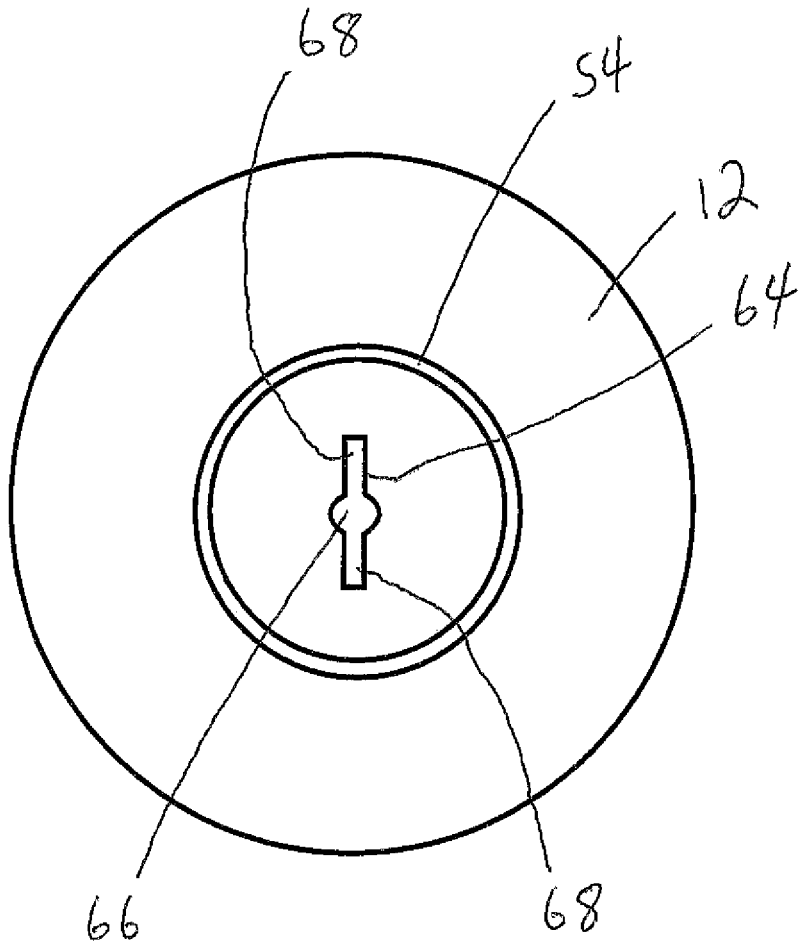
FIG. 5 is a top view of the base plate portion of the patio mount shown in FIG. 1.
Figure 6:
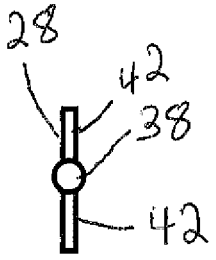
FIG. 6 is a cross sectional view taken along line A-A in FIG. 2 of the elongated hook member portion of the present invention.

Referring now to FIGS. 5 and 6, keyhole opening 64 is positioned at the very centre of base member 12 and within collar 54. Keyhole opening 64 has a central circular aperture 66 configured to receive cylindrical threaded portion 38 of elongated hook member 28 while slots 68 radiate from the central circular aperture to receive flat planar portion 42 of elongated hook member 28. Keyhole opening 64 effectively ensures that the elongated hook member can only be inserted in one orientation. Furthermore, when elongated hook member 28 is fully inserted into keyhole opening 64, the elongated hook member cannot be rotated relative to base member 12. Jam nut 58 (see FIGS. 2 and 4) has a diameter greater than the diameter of circular aperture 66 or slots 68 and therefore cannot pass through the keyhole opening.

Figure 3:
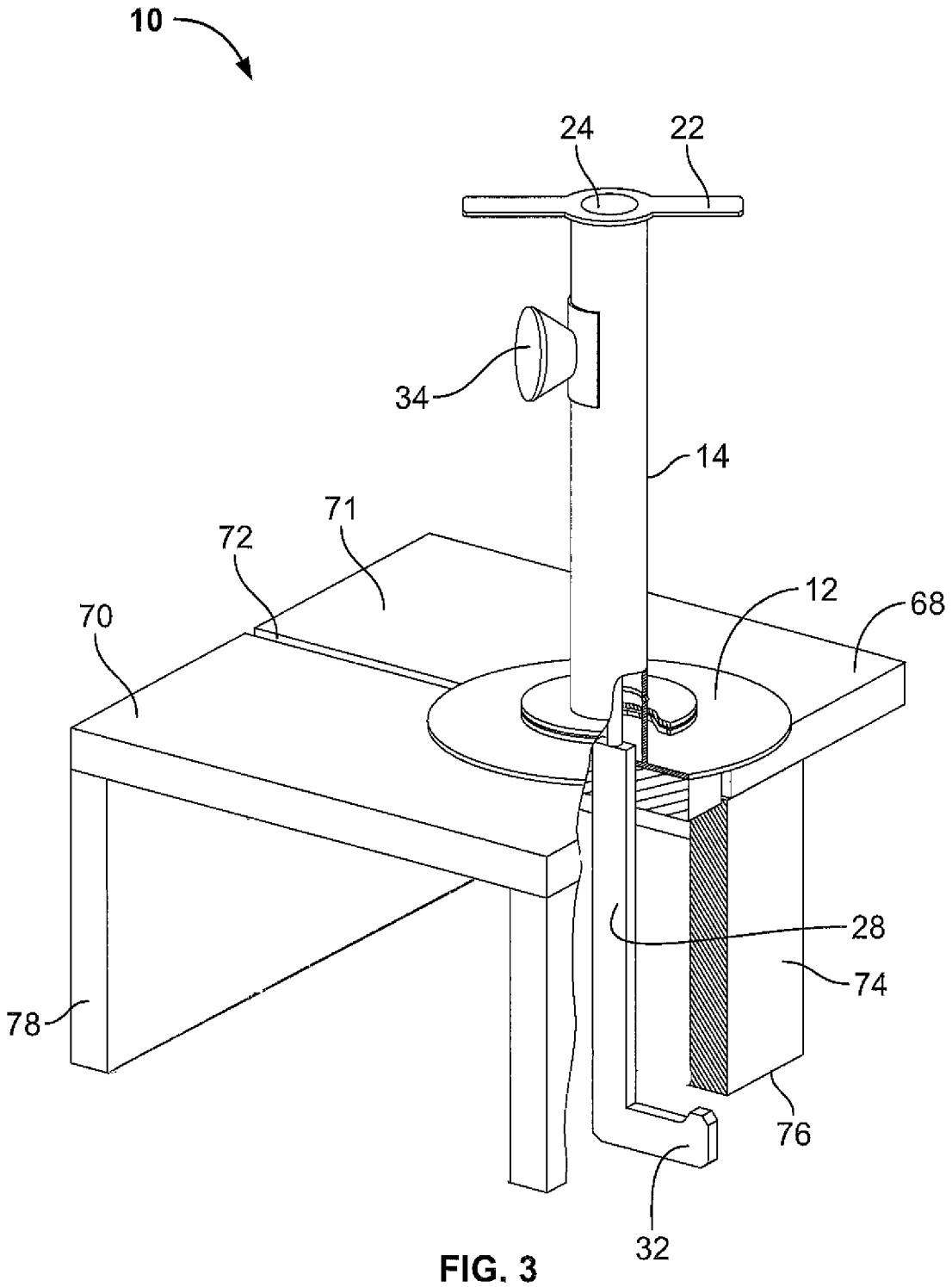
FIG. 3 is a perspective view of the patio mount shown in FIG. 1 mounted to a wooden patio deck.

Referring now to FIG. 3, when assembled, mount 10 is positioned onto patio deck 71. Patio deck 71 is formed from a plurality of flat decking members supported by a plurality of vertically oriented joists. The decking members are separated from each other by narrow gaps. Mount 10 is positioned onto deck 71 such that base member straddles gap 72 separating decking members 68 and 70 and the centre of the mount is positioned above joist 74. Elongated hook member 28 is then passed through gap 72 and elongated hook member 28 is positioned adjacent to joist 74 with hook 32 positioned below lower edge 76 of joist 74. Handle 22 of cylinder 14 is then engaged to rotate cylinder 14 relative to base 12 in order to raise hook 32 to physically engage edge 76 of joist 74. Sufficient torsional force is applied to handle 22 to force the hook tightly onto the edge 76, thereby locking the elongated hook member in place and strongly securing mount 10 onto patio 71. If sufficient torsional force is applied to handle 22, collar 62 applies a strong linear force on elongated hook member 28 thereby strongly biasing hook 32 towards base member 12 resulting in a secure coupling of mount 10 to the patio. The stem of a patio umbrella (not shown) or other similar object can then be inserted into cylinder 14 and locked into place by clamp 34. Any forces applied transversely onto cylinder 14 are transmitted to decking members 68 and 70 by base 12 and to joist 74 by elongated hook member 28. The distance separating base member 12 on deck members 68/70 and hook 32 on lower edge 76 of joist 74 ensures sufficient leverage so that only an enormously strong force on cylinder 14 could cause mount 10 to fail. The mount can be removed by simply engaging handle 22 to rotate cylinder 14 to disengage hook 32 off joist 74, permitting the elongated hook member 28 to be removed from gap 72.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art.

What is claimed is:

1. A patio support for securely supporting an object to a patio, the patio having a plurality of parallel deck members supported by a plurality of joist members transversely oriented relative to the deck members, the deck members being separated from each other by elongated gaps, the elongated gaps having a width, the joist members having a height defined by opposite upper and lower edges, the patio support comprising:

a base member having a first portion, the base member being flat and dimensioned to lay on top of two adjacent deck members and above the joist member supporting said two adjacent deck members, the base member dimensioned so as to span the elongated gap between the adjacent deck members and position the first portion directly above said elongated gap;

a mounting member mounted to a top portion of the base member, the mounting member configured to releasably mount to the object;

a hook member mounted to the base member such that the hook member depends downward from the first portion of the base member;

the hook member having a top end coupled to the base member, a lower end opposite the top end, opposite side edges and opposite side faces and a hook formed at the lower end;

the hook member having a length extending between the hook member's top and bottom ends;

the hook member having a thickness between the opposite side faces and a width between the opposite side edges, the thickness of the hook member being less than the width of the elongated gap and the width of the hook member being greater than the width of the elongated gap;

the length of the hook member being greater than the height of the joist members, the length of the hook member being further selected so as to position the hook below the lower edge of the joist;

the hook member being retractably mounted to the base member such that the hook at the bottom end of the hook member can be secured between a lowered position wherein the hook is positioned below the lower edge of the joist and a raised position wherein the hook securely engages the lower edge of the joist, the patio support being configured to lock the hook member in its raised position, and wherein the hook member has a cylindrical threaded portion and a planar flat portion, the cylindrical threaded extending downward from the top end and the planar flat portion extending upward from the bottom end, the planar flat portion being dimensioned to fit within the gap separating the parallel deck members, the central portion of the base member having an opening for receiving the cylindrical threaded portion of the hook member, the patio support further comprising a threaded collar for locking the hook member in its raised position by threading onto the cylindrical threaded portion of the hook member.

2. The patio support of claim 1 wherein the mounting member comprises a cylindrical tube mounted to the first portion of the base member, the cylindrical tube having an adjustable clamp for securing the object to the cylindrical tube.

3. The patio support of claim 2 wherein the cylindrical tube, base member and cylindrical threaded portion are all coaxially aligned and wherein the threaded collar is formed within the cylindrical tube.

4. The patio support of claim 3 wherein the cylindrical tube has opposite first and second ends with a flange projecting transversely from said first end, the base member having a flat surface upon which the flange is set, a flat annular washer being coaxially aligned with the cylindrical tube and interposed between the flange and flat surface of the base member, base member and flange being made of a strong metal, the flat annular washer being made of a non-metal material configured to prevent metal on metal frictional contact between the flange and the flat surface of the base member.

5. The patio support of claim 4 wherein a pair of handles project transversely from the second end of the cylindrical tube.

6. The patio support of claim 5 wherein a tubular collar is coaxially formed on the first portion of the base member at a centre of the flat surface, the flat washer being concentric with the tubular collar, the tubular collar having a top edge, the first end of the cylindrical tube being coaxially and rotatably mounted to the tubular collar.

7. The patio support of claim 6 wherein the centre of the flat surface has a keyhole aperture dimensioned to permit the cylindrical threaded portion of the hook member and a segment of the planar flat portion adjacent the cylindrical threaded portion of the hook member to pass through, the keyhole aperture formed as a wider circular hole with narrower projecting slots extending there from.

8. The patio support of claim 6 further comprising a jam nut dimensioned to thread onto the cylindrical threaded portion of the hook member, the jam nut being dimensioned to fit within the tubular collar, the jam nut being further dimensioned to not pass through the keyhole aperture.

9. A patio support for securely supporting an object to a patio, the patio having a plurality of parallel deck members supported by a plurality of joist members perpendicularly oriented relative to the deck members, the deck members being separated from each other by elongated gaps, the elongated gaps having a width, the joist members having a height defined by opposite upper and lower edges, the patio support comprising:

a base member configured to rest on top of the deck members;

a mounting member mounted to a top portion of the base member, the mounting member configured to releasably mount to the object;

an elongated member having opposite top and bottom ends, the bottom end extending downward from the base member, a hook portion formed on the bottom end, the elongated member being sufficiently long such that the bottom end can extend below the lower edge of the joists, the elongated member being further dimensioned to pass through the elongated gaps;

the elongated member being movably mounted to the base member between a lowered position wherein the hook is positioned below the lower edge of the joists and a raised position wherein the hook securely engages the lower edge of the joists, the patio support being configured to lock the elongated member in its raised position;

wherein the elongated member has a thickness less than the width of the gaps, the elongated member also having a width greater than the width of the gaps;

wherein the patio support is adapted to bias the hook towards the base member when the elongated member is locked in its raised position thereby pressing the base member securely onto the deck members when the patio support is mounted to the patio, and wherein the base member has a flat portion with an aperture formed thereon, the elongated member having a threaded portion extending from the top end, the threaded portion passing through the aperture, the patio support further comprising a threaded collar threaded onto the threaded portion with the flat portion of the base member interposed between the bottom end and the threaded collar, the threaded portion of the elongated member and the threaded collar configured such that rotating the threaded collar moves the elongated member between its lowered and raised positions.

10. The patio support member of claim 9 further comprising a cylindrical tube having opposite first and second ends, the first end being rotatably mounted to a tubular collar formed on the flat portion of the base member, the threaded collar being mounted within the cylindrical tube, the cylindrical tube, tubular collar, threaded collar, aperture and threaded portion of the elongated member all being coaxially aligned, the cylindrical tube being coupled to at least one handle for providing a mechanical advantage when rotating the cylindrical tube.

11. The patio support member of claim 10 wherein the cylindrical tube has a flat flange radiating from the first end, the flat flange being parallel with the flat portion of the base member, a washer concentrically interposed between the flat flange and the flat portion of the base member, the washer made of a nonmetallic material and is dimensioned and configured to prevent contact between the flat flange and the flat portion of the base member.

12. The patio support member of claim 10 wherein the threaded portion of the elongated member is cylindrical and wherein the elongated member further comprises a flat portion extending between the threaded portion of the elongated member and the lower end of the elongated member, the flat portion of the elongated member having a wider diameter than a diameter of the threaded portion of the elongated member, the aperture comprising an elongated slot having a central circular portion, the central circular portion of the aperture dimensioned to permit the threaded portion of the elongated member to pass there through, the elongated slot of the aperture dimensioned to permit the flat portion of the elongated member to pass there through.

13. The patio support member of claim 10 further comprising a jam nut threaded onto the threaded portion of the elongated member between the threaded collar and the flat portion of the base member, the jam nut dimensioned to not pass through the aperture in the flat portion of the base member.

* * * * *